United States Patent [19]

Seymour-Smith

[11] 4,216,863

[45] Aug. 12, 1980

[54] BAG PACK

[75] Inventor: Donald Seymour-Smith, Bristol, England

[73] Assignee: A. J. Bingley Limited, Bristol, England

[21] Appl. No.: 22,362

[22] Filed: Mar. 20, 1979

[30] Foreign Application Priority Data

Mar. 21, 1978 [GB] United Kingdom ..... 11158/78

[51] Int. Cl.[2] ..... B65D 83/00; B65D 85/62

[52] U.S. Cl. ..... 206/554; 206/526

[58] Field of Search ..... 206/554, 494, 526; 221/48, 47, 63

[56] References Cited

U.S. PATENT DOCUMENTS

| | | | |
|---|---|---|---|
| 2,811,280 | 10/1957 | Commiso et al. | 206/494 |
| 3,281,056 | 10/1966 | Kugler | 206/554 |
| 3,306,492 | 2/1967 | Kugler | 206/554 |
| 3,420,433 | 1/1969 | Bostwick | 206/554 |
| 3,718,253 | 2/1973 | Smith | 221/63 |

*Primary Examiner*—William T. Dixson, Jr.

*Attorney, Agent, or Firm*—Wenderoth, Lind & Ponack

[57] ABSTRACT

A package of bags of plastics film material, e.g. for storing food, comprises a wallet of plastics film containing a stack of bags. Each bag in the stack is individually folded in half with separate folds. A removable panel allows the bags to be removed from the wallet. The bags can be taken out one-by-one leaving the remainder neatly in the pack.

12 Claims, 2 Drawing Figures

BAG PACK

BACKGROUND OF THE INVENTION

The invention relates to bag packs, i.e. packages of bags, for example for use for storing food. In particular, the present invention is concerned with bag packs containing a stack of bags of plastics film material.

A common problem with bag packs of this kind is that it is difficult, if not impossible, to remove the bags from the pack one-by-one, leaving the remaining bags neatly contained in the pack. The problem arises because the bags in the pack are supplied as flat double layers of, e.g. plastics material; and, in order for the complete pack to be reasonably compact, the flat bags in the pack are folded over at least once. This folding is usually done to a stack of bags as a whole, so that the bags tend to be interlocked with one another and therefore difficult to remove singly from the folded stack in the pack.

SUMMARY OF THE INVENTION

According to the present invention a bag pack comprises a wallet of flexible sheet material enclosing and containing a stack of bags of plastics film material, each bag in the stack being individually folded in half and the wallet being formed with means for gaining access to the bags from outside the wallet whereby bags can be removed singly from the wallet.

Because the bags are individually folded in half the problem of bags in the stack interlocking is completely obviated, whilst at the same time, the advantage of providing a compact packet of bags is still maintained. The bags can then easily be removed from the pack one-by-one as required.

Preferably, the wallet is made of plastics film material of a thicker gauge that the material of the bags. Preferably also the wallet comprises a single rectangular sheet of the plastics film, folded in half and sealed together along the three non-folded edges to form a pocket containing the stack of bags.

Conveniently, the means for gaining access to the bags in the wallet comprises a perforated line in the sheet material on at least one side of the wallet forming a removable panel located near an edge of the wallet and dimensioned so that bags can be removed singly from the stack through the opening formed when the panel is removed. The edge of the panel nearest the proximate edge of the wallet is preferably spaced therefrom. Then, all four edges of the wallet are complete and effectively retain the stack of bags in the wallet except when individual bags are deliberately removed from the stack through the opening formed when the panel is removed. The bags of the stack preferably occupy in the folded form a width perpendicular to the folds which is less than the length of the bags parallel to the folds. Then the removable panel in the wallet is preferably located near one of the shorter edges of the wallet perpendicular to the folds of the bags. Such one of the shorter edges of the wallet may be conveniently the folded edge of the material of the wallet. The opposite edge of the wallet may be provided with means for hanging the wallet depending vertically with the removable panel towards the bottom of the wallet.

In a preferred embodiment, the bags of the stack are of polyethylene film and preferably the wallet itself is also made of polyethylene film.

BRIEF DESCRIPTION OF THE DRAWINGS

An example of the invention will now be described with reference to the accompanying drawings in which.

DETAILED DESCRIPTION OF THE INVENTION

Figures 1, 2:
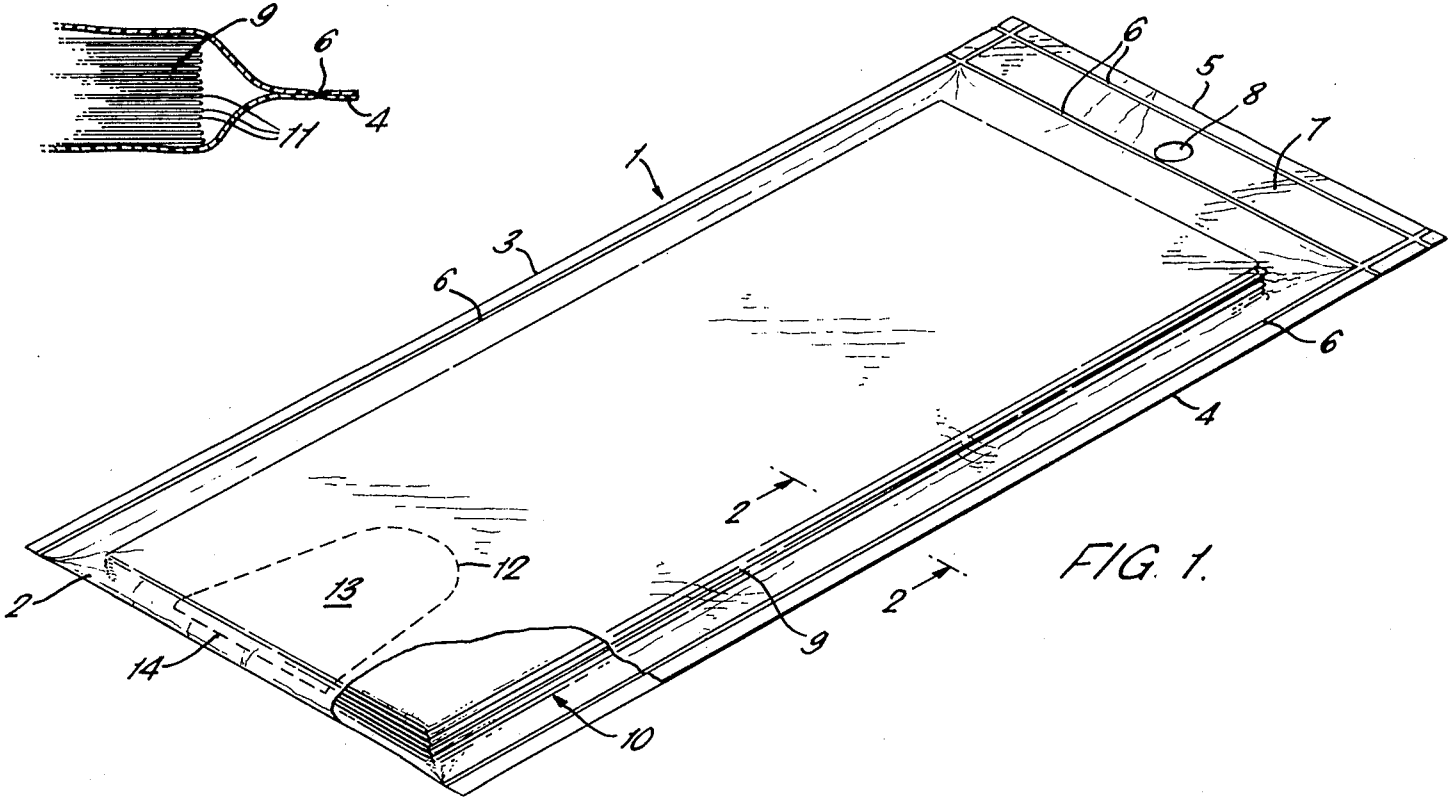
FIG. 1 is a perspective view of a bag pack embodying the present invention.
FIG. 2 is a cross-sectional view taken along line 2—2 of FIG. 1.

Referring to the drawings, a bag pack comprises a wallet 1 formed of an elongate sheet of polyethylene film. Although this film is shown substantially transparent in the Figure, in practice the film may be coloured or opaque and then printed or otherwise marked with decorative or promotional material and instructions for use. The elongate rectangle of the material of the wallet is folded in half across its width to form a bottom folded end 2 of the wallet 1. The two lateral edges 3 and 4 and the opposite end edge 5 of the wallet are closed by seams 6, which for heat-sealable plastics film as in the present case may be formed by welding the layers of the material together in a manner well known in the art.

At the edge 5 of the wallet, the wallet is closed by two parallel seams 6 providing a strengthened flat tab portion 7 at this end of the wallet in which there is punched a hole 8 by which the entire wallet and contents may be suspended depending vertically from a hook. The wallet contains a stack 9 of bags made of polyethylene film of a finer gauge than the material of the wallet itself. A corner portion of the upper sheet of the wallet 1 is torn away in FIG. 1 to show the stack of bags more clearly.

FIG. 2 is an enlarged cross-sectional view right through the thickness of the wallet and the stack 9 of bags contained therein towards the right-hand edge 4 of the wallet as shown in FIG. 1. As can be seen most clearly in FIG. 2, each of the bags 11 in the stack 9 is individually folded in half. The bags are located in the wallet with their folded edges 10 parallel to and adjacent the lateral edge 4 of the wallet. It will be appreciated that each individual bag of the stack 9 is typically itself formed of a folded rectangle of the polyethylene film with the two layers of the film sealed together along the lateral edges at right angles to the fold. The edge of the bag opposite the fold thus forms the mouth of the bag. The bags in the stack 9 are individually folded in half along lines parallel to these sealed lateral edges.

As can be seen in FIG. 1, the upper sheet of the material of the wallet 1 has a perporated line 12 forming a removable panel 13 in the sheet near the folded edge 2 of the wallet. The panel 13 has a substantially straight line edge 14 parallel with but spaced from the folded edge 2 so that the folded edge 2 is continuous across the width of the wallet. In this way, the folded edge can continue to retain the stack 9 of bags in the wallet even with the panel 13 removed and when the wallet is suspended by the hole 8. The remaining parts of the panel 13 are shaped substantially symmetrically to provide, when the panel is removed an opening in the wallet providing access to the stack 9 of bags of sufficient size that bags of the stack can be easily removed singly from the wallet by hand.

I claim:

1. A bag pack comprising:

a wallet of flexible sheet material enclosing and containing a stack of bags of plastics film material;

each said bag in said stack of bags being individually and separately folded in half so that said bags are not nested or interlocked together; and said wallet being formed with means for gaining access to said bags from outside said wallet, whereby said bags can be removed singly from said wallet.

2. A bag pack as claimed in claim 1, wherein said wallet is made of a plastics film material of a thicker gauge than the material of said bags.

3. A bag pack as claimed in claim 2, wherein said wallet comprises a single rectangular sheet of the plastics film material folded in half and sealed together along three non-folded edges to form a pocket containing said stack of bags.

4. A bag pack as claimed in claim 1, wherein said means for gaining access comprises a perforated line in said sheet material on at least one side of said wallet, said perforated line forming a removable panel located near an edge of said wallet and dimensioned so that said bags can be removed singly from said stack through an opening formed when said panel is removed.

5. A bag pack as claimed in claim 4, wherein the edge of said panel nearest the proximate edge of said wallet is spaced therefrom.

6. A bag pack as claimed in claim 4, wherein said bags of said stack occupy in the folded form a width perpendicular to the folds of said bags which is less than the length of said bags parallel to said folds, and said removable panel in said wallet is located adjacent one shorter edge of said wallet perpendicular to said folds of said bags.

7. A bag pack as claimed in claim 6, wherein said one shorter edge of said wallet is a folded edge of said sheet material forming said wallet.

8. A bag pack as claimed in claim 7, wherein an edge of said wallet opposite said one edge is provided with means for hanging said wallet to depend vertically with said removable panel positioned towards the bottom of said wallet.

9. A bag pack as claimed in claim 19, wherein said opposite edge of said wallet is closed by two parallel seams providing a strengthened flat tab portion provided with a hole for hanging said wallet.

10. A bag pack as claimed in claim 1, wherein said bags of said stack are formed of polyethylene film.

11. A bag pack as claimed in claim 1, wherein said wallet is made of polyethylene film.

12. A bag pack comprising:

a wallet of plastics film material;

a stack of bags of plastics film material enclosed by and contained in said wallet;

said film material of said wallet having a thicker gauge than said film material of said bags;

each said bag in said stack of bags being individually and separately folded in half so that said bags are not nested or interlocked together;

said stack of bags so folded occupying a width perpendicular to the folds of said bags which is less than the length of said bags parallel to said folds;

said wallet comprising a single rectangular sheet of the plastics film material folded in half along a folded edge and sealed together along three non-folded edges to form a pocket containing said stack of bags, with said folded edge of said wallet being one of the shorter edges of said wallet so that said folds of said stack of bags contained within said wallet extend perpendicular to said folded edge of said wallet;

said wallet further having a perforated line in said sheet material of said wallet on at least one side of said wallet, said perforated line forming a removable panel located near said folded edge of said wallet and dimensioned so that said bags can be removed singly from said stack through an opening formed when said panel is removed; and an edge of said wallet opposite to said folded edge being provided with means for hanging said wallet to depend vertically with said removable panel positioned towards the bottom of said wallet, whereby said bags can be withdrawn singly through said opening when said panel is removed by pulling each said bag substantially downwardly.

* * * * *